US005108336A

United States Patent [19]

Rosier

[11] Patent Number: 5,108,336

[45] Date of Patent: Apr. 28, 1992

[54] SAND PLAY SHOVEL WITH SCULPTURE MOLD

[76] Inventor: Philip Rosier, 1/21 Carnarvon St., Carlton N.S.W. 2218, Australia

[21] Appl. No.: 667,651

[22] Filed: Mar. 11, 1991

[51] Int. Cl.[5] ..... A63H 33/32; A63H 33/04; G09B 11/00; B28B 7/34

[52] U.S. Cl. ..... 446/70; 446/86; 446/144; 434/81; 425/276; 425/470; 425/DIG. 126; 249/134; 249/DIG. 1

[58] Field of Search ..... 249/205, 187.1, 134, 249/DIG. 1; 425/276, 470, 472, DIG. 44, DIG. 126, DIG. 127; D21/120, 59; 434/81, 82; 446/70, 69, 71, 72, 73, 74, 76, 85, 86, 97, 99, 100, 117, 144, 145

[56] References Cited

U.S. PATENT DOCUMENTS

| | | | |
|---|---|---|---|
| D. 34,617 | 6/1901 | Repetti | 425/470 X |
| D. 117,555 | 11/1939 | Bojesen | D21/120 |
| D. 261,540 | 10/1981 | Appel et al. | D21/120 |
| D. 272,552 | 2/1984 | Clanton | D21/120 |
| 1,030,054 | 6/1912 | Charles | 446/71 |
| 1,247,003 | 11/1917 | Preston, Jr. | 446/144 |
| 2,968,838 | 1/1961 | Hicks | 425/470 X |
| 3,047,979 | 8/1962 | Hrucz | 446/144 |
| 3,359,677 | 12/1967 | Hepler | 446/70 |
| 3,434,232 | 3/1969 | Tarrson | 446/70 |
| 3,447,256 | 6/1969 | Compton | 446/70 |
| 3,561,155 | 2/1971 | Tarrson | 446/70 |
| 3,685,942 | 8/1972 | Shaffer | 446/86 X |

FOREIGN PATENT DOCUMENTS

| | | | |
|---|---|---|---|
| 1032664 | 4/1953 | France | 434/82 |
| 12709 | of 1891 | United Kingdom | 446/70 |

OTHER PUBLICATIONS

"Clay Pictures", Amaco, *Playthings*, Feb. 1960, p. 117, 434–4083256814 81.

*Primary Examiner*—David N. Muir
*Attorney, Agent, or Firm*—Harry M. Weiss

[57] ABSTRACT

A shovel is disclosed which is preferably a play shovel for use by a child or adult for making a molded head and neck of any desired character or object such as a storybook or cartoon character in the sand. The shovel includes a bottom spade portion and a middle handle portion and a top head portion. The head and handle portions have walls forming a mold cavity opening at the back. The head portion has inner and outer surfaces having features of the head of a character formed thereon.

11 Claims, 1 Drawing Sheet

SAND PLAY SHOVEL WITH SCULPTURE MOLD

FIELD OF THE INVENTION

The invention generally relates to shovels and methods of use therefore and, in particular, the invention relates to a play shovel and method having a handle and head forming a mold in the shape of a storybook or cartoon character.

BACKGROUND OF THE INVENTION

The prior art play shovel includes a spade portion and a handle portion.

One problem with the prior art play shovel is that it has a singular purpose, namely, to permit a child to dig in the sand. Often a child will use the prior art type of play shovel to lift sand into a bucket to carry sand for use in creating some form of structure.

Sand structures are a great form of amusement and entertainment for young children and even adults enjoying sandy beaches. Wet sand is often used to create structures on a beach because of the relative ease in using wet sand instead of dry sand to shape sand structures. In forming wet sand structures, children and adults have generally used their hands to shape the sand such as by stroking and smoothing the sand to create desired roundness and configuration. The disadvantage of using hands to shape wet sand structures is that the fingers and hands need to be constantly cleaned with water to remove sand particles especially when a child or person is using their hands to eat food such as a sandwich, etc. Also, unless the person or child using wet sand to build sand structures is very artistic, it is exceedingly difficult to form wet sand structures that have nice shapes or configurations that are pleasing to the sand structure creator and others viewing the sand structure.

Therefore, a need existed for a play shovel and method that would serve both as a means of carrying sand and also to provide a means for shaping wet sand to create artistic sand structures.

SUMMARY OF INVENTION

Accordingly, it is an object of this invention to provide an improved shovel and method.

It is another object of this invention to provide an improved play shovel and method.

It is a further object of this invention to provide an improved play shovel and method which can be used to both carry sand and to form artistic sand structures.

It is a still further object of the invention to provide a play shovel for use by a child to easily form in the sand a molded head of a storybook or cartoon character.

Another object of this invention is to provide a method of forming in the sand a molded head of a storybook or cartoon character.

A still further object of this invention is to provide a spade and mold of one-piece construction for ease of carrying by a child.

The foregoing and other objects, features and advantages will be apparent from the following description of the preferred embodiment of the invention as illustrated in the accompanying drawings.

BRIEF DESCRIPTION OF PREFERRED EMBODIMENT

According to the present invention, a play shovel for use by a child is provided. This shovel comprises a bottom spade portion and a middle handle portion and a top head portion which has a front wall and peripheral wall enclosing a mold cavity that is in the shape of, for example, a storybook character, however, other shapes and configurations can be formed by the mold cavity created by the middle handle and top head portions, as desired. By using the spade portion, a child can pile up a mound of dry or wet sand; and by using the mold cavity created by the hollow handle and top head portions, the child can simply push the hollow back of the shovel into wet sand to form a beautiful and artistic shape or configuration therein or, if desired can pack the mold cavity by hand with the wet sand and, if desired, carry the molded sand configuration to any desired site or location to place the molded wet sand structure thereon. By using the peripheral wall portion of the handle and top head portions, the child can turn over the shovel and mold cavity; and can subsequently deposit the molded sand configuration on any desired support surface.

A method of forming a sand structure such as the head of a storybook character for use by a child is also provided. This method includes the steps of, forming a play shovel having an elongate handle having a first mold cavity portion and first and second end portions; affixing a head portion having a second mold cavity portion at the first end portion affixing a spade portion having an edge portion at the second end portion; packing the first and second mold cavity portion with wet sand; turning over the first and second mold cavity portions filled with wet sand; and depositing the molded wet sand on a support surface.

DESCRIPTION OF THE PREFERRED EMBODIMENT

Figure 1:
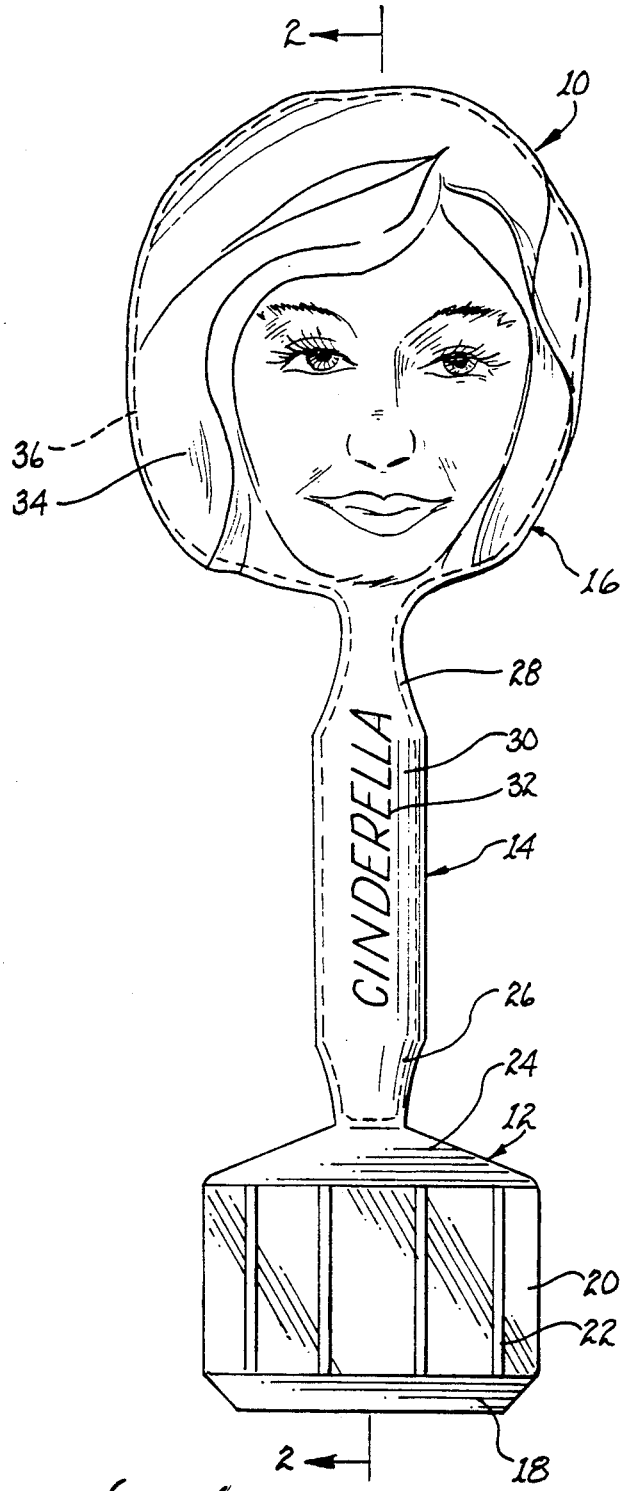
FIG. 1 is a front elevational view of a play shovel according to the present invention showing a bottom shovel portion, a middle or intermediate handle portion, and a top head portion.

As shown in FIG. 1, a play shovel 10 is provided. Shovel 10 includes a bottom spade or blade portion 12, and a middle handle portion or handle 14, and a top portion, or facial character mold, or head 16.

Spade portion 12 has an edge portion or lower portion or edge 18, and a center portion 20 which preferably has a plurality of stiffeners 22, and an upper portion 24. If desired, the spade portion 12 can be a simple somewhat curved blade structure suitable for scooping up sand.

Handle 14, which has an arcuate shape in cross-section (see FIGS. 1 and 2), has preferably a first bottom tapered part 26, which is preferably fixedly connected to spade 12. Handle 14 also has preferably a second top tapered part 28, which is preferably fixedly connected to head 16. Handle 14 also has center part 30, which preferably has indicia, or a character name 32, which is "CINDERELLA" in this embodiment. If desired, any name can be used to form the desired name of the character or to form any unrelated name in the wet sand that is in contact with the inside of the handle 14. Handle 14 has an elongate recess or cavity 33 at its rear side (see FIG. 2).

Shovel 10 is preferably made of any suitable plastic material which has rounded edges for safety and for avoidance of scratches or cuts on the child as user.

Head 16, which is hollow, has a front wall 34 and an annular or peripheral wall 36, which together form a hollow mold cavity 38 (see FIG. 2) that is open at the rear. Walls 34, 36 preferably have a substantially constant or uniform thickness. Head 16, which serves as a mold of a head, receives a mold material, such as wet sand. Cavity 38 receives the wet sand mold material, and forms the shape and features of a head, such as the head of a storybook or cartoon character, or the like. Cavity or recess 33 of the handle 14 can serve to form the "neck" portion of the head character using the wet sand placed or located thereon.

Figure 2:
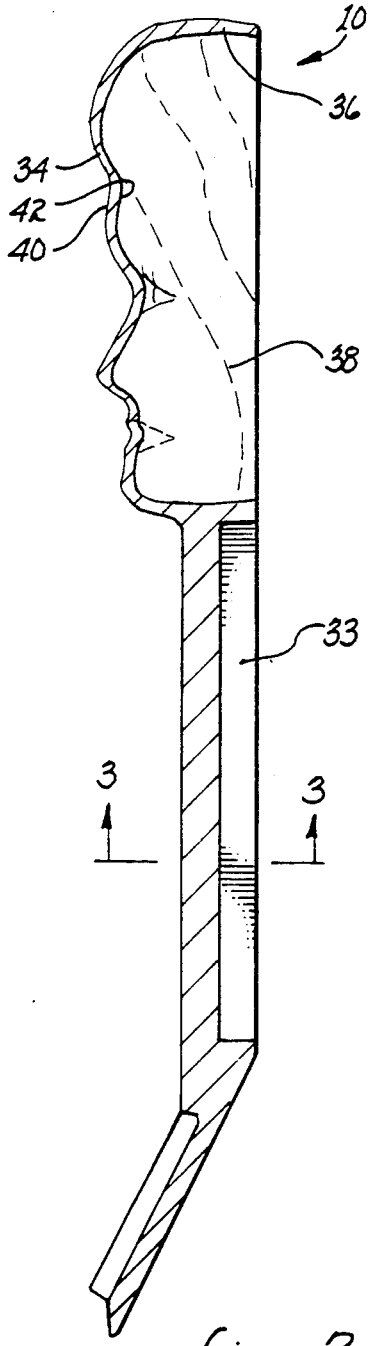
FIG. 2 is a section view as taken along the line 2—2 of FIG. 1.
Figure 3:
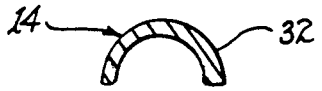
FIG. 3 is a section view as taken along the line 3—3 of FIG. 2.

Head 16 also has an outer surface 40 and an inner surface 42 (see FIG. 2). Surfaces 40, 42, in the embodiment of FIG. 1, have the features of the storybook character "CINDERELLA", including the features of the nose, eyes, mouth and hair.

METHODS OF USE

In one form of use, head 16 is placed face down on a sand surface, with rear cavity 38 facing upwardly. This means that handle 14 is also placed face down with its rear cavity 33 facing upwardly. Previously, a mound of wet sand was made or formed such as by using handle 14 and spade 12. Parts of the wet sand mound are packed by hand into the cavity 38 and into the cavity 33. Head 16 is then turned over by holding and using the exterior peripheral wall portion of handle 14. The wet sand molded materials within cavities 38 and 33 are deposited on a sand surface, or like support surface. Thus, a child can easily and simply fill the mold cavity of the head and handle of the play shovel which is open at the rear side. The child can then turn over shovel 10 so that the imprints from the head 16 and the handle 14 will be exposed to the sand surface.

The advantages of shovel 10 are that a child or adult can form or mold any desired character such as a storybook or cartoon character on a sand or like surface using wet sand or the like, that a child or adult can use parts of the shovel, which has a spade for digging a mound of dry or wet sand and which has a head with a mold cavity, for molding the head of a storybook character from wet sand, and that a child or adult can easily carry and use the combined shovel and mold which is a one-piece construction.

While the invention has been described in its preferred embodiment, it is to be understood that the words which have been used are words of description rather than limitation and that changes may be made within the purview of appended claims without departing from the true scope and spirit of the invention in its broader aspects.

I claim:

1. A play shovel for use by a child or adult comprising, in combination:

bottom spade portion means for digging;

a middle handle portion having a first end portion fixedly connected to the bottom spade portion means and having a second end portion; and a top mold portion integrally connected at the second end portion, extending in substantially the same linear direction as said middle handle portion, and having a hollow mold cavity means shaped in a facial design for forming for forming a simulated face after filling with a granular substance such as sand.

2. The shovel of claim 1 wherein the shovel is made of plastic material.

3. The shovel of claim 1 wherein a character familiar to children is formed by said hollow mold cavity means and the middle handle portion has a name corresponding to the character of the top head portion.

4. The shovel of claim 3 wherein said top head portion having outer and inner surfaces separated by a substantially uniform wall thickness and having features of the nose, eyes and mouth and hair of the character.

5. The shovel of claim 1 wherein the bottom spade portion has an edge portion and a center portion with a plurality of stiffeners and an upper portion fixedly connected to the handle first end portion; and wherein the middle handle first and second end portions are tapered portions fixedly connected to a middle handle center portion.

6. The shovel of claim 1 wherein the middle handle portion having a hollow mold cavity, the hollow cavity means of the top head portion is in the shape of the head of a person, the hollow mold cavity of the middle handle portion is the neck for the head of the person.

7. A play shovel comprising:

a bottom spade portion;

a middle handle portion attached to said spade portion further having a hollow mold cavity therein; and a top mold portion attached to said handle portion having a front and side peripheral wall surfaces enclosing a mold cavity that is in the shape of the face of a storybook character, said hollow mold cavity in said middle handle portion is the neck of the head of the storybook character.

8. A method for a child or adult molding an object using a play shovel having an elongate handle attached to a face mold located at an end of the handle extending in substantially the same linear direction of the handle, and having a mold cavity formed therein comprising the steps of:

packing the mold cavity at the end of the handle with a granular substance such as wet sand;

gripping the handle and turning over the mold cavity with its packed wet sand;

depositing the molded packed wet sand from the mold cavity on a support surface; and removing the shovel.

9. The method of claim 8 including the step of providing a cavity on the back of said handle; and packing wet sand into said handle to form a wet sand configuration shaped like the cavity in the back of said handle.

10. The method of claim 8 wherein the object is a cartoon character formed by said mold cavity.

11. A method for a child or adult molding an object using a play shovel having an elongate handle attached to a head having a mold cavity formed therein comprising the steps of:

packing the mold cavity with wet sand;

gripping the handle and turning over the mold cavity with its packed wet sand;

depositing the molded packed wet sand from the mold cavity on a support surface;

providing a cavity on the back of said handle; and packing wet sand into said handle to form a wet sand configuration shaped like the cavity in the back of said handle, the object is a cartoon character formed by said mold cavity and the handle cavity forms a neck portion of said cartoon character.

* * * * *

UNITED STATES PATENT AND TRADEMARK OFFICE

CERTIFICATE OF CORRECTION

PATENT NO. : 5,108,336

DATED : 4-28-92

INVENTOR(S) : Philip Rosier

It is certified that error appears in the above-identified patent and that said Letters Patent is hereby corrected as shown below:

Col. 3, line 66, delete "for forming", second occurrence.

Col. 7, line 25, after "said" insert -- bottom --.

Col. 7, line 26, before "further" insert -- and --.

Col. 7, line 27, before "handle" insert -- middle --;

after "handle portion" insert -- and further --.

Signed and Sealed this

Seventeenth Day of August, 1993

Bruce Lehman

*Attest:*

BRUCE LEHMAN

*Attesting Officer*

*Commissioner of Patents and Trademarks*